US006089307A

United States Patent [19]

Waters, Sr. et al.

[11] Patent Number: 6,089,307

[45] Date of Patent: Jul. 18, 2000

[54] ASSEMBLY FOR CASTING

[76] Inventors: Joe C. Waters, Sr., 4047 Mullinkin Rd., Evans, Ga. 30809; Michael C Abernathy, 428 W. Glade Rd., Anniston, Ala. 36206

[21] Appl. No.: 09/084,260

[22] Filed: May 14, 1998

[51] Int. Cl.[7] ..... B22C 7/02; B22C 9/04

[52] U.S. Cl. ..... 164/237; 164/244; 164/376; 249/54; 249/62

[58] Field of Search ..... 164/237, 238, 164/239, 240, 376, DIG. 4, 244; 249/54, 61, 62

[56] References Cited

U.S. PATENT DOCUMENTS

| | | | |
|---|---|---|---|
| 699,006 | 4/1902 | Palmer | 164/376 |
| 1,369,182 | 2/1921 | Moore | 164/376 |
| 1,372,209 | 3/1921 | Terranova | 164/376 |
| 2,417,812 | 3/1947 | Curren | 249/54 |
| 2,428,094 | 9/1947 | Raymond | 249/54 |
| 3,610,317 | 10/1971 | Benfield et al. | 164/238 |
| 4,494,934 | 1/1985 | Huffman | 249/54 X |

FOREIGN PATENT DOCUMENTS

| | | | |
|---|---|---|---|
| 464274 | 4/1950 | Canada | 249/54 |
| 3124819 | 2/1982 | Germany | 249/54 |

*Primary Examiner*—J. Reed Batten, Jr.

[57] ABSTRACT

The casting assembly includes a horseshoe shaped casting ring having a plurality of handling posts; a horseshoe shaped crucible former having a flange for retaining the casting ring and a top surface for supporting the casting ring; and a pair of tongs having a plurality of openings, each of the openings adapted to receive one of the handling posts.

9 Claims, 3 Drawing Sheets

ASSEMBLY FOR CASTING

CROSSREFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

Casting is both an art and a science governed by numerous rules, or "laws." Personal interpretation of these laws is demonstrated in a technician's approach to the procedures involved in the art of casting. Integrating the theoretical principles supporting this process enables one to blend science with art in dental technology.

Success in fabricating metal ceramic crowns and fixed partial dentures depends to a large extent on obtaining high quality castings that are properly designed and well fitting.

One of the most common problems in casting results from heat distortion due to the limited number of shapes of casting rings currently available as well as the shortcomings in the construction composition of those presently available.

Our newly invented Horseshoe Shaped Casting Ring and Crucible Former addresses these common heat distortion problems.

In casting, the correct calculation of the geometric center and the heat center of the casting ring are critically important to achieve the best results. The center of mass (investment) may be different from the geometric center of the casting ring and consequently becomes the casting ring's true thermal zone. Correspondingly, the center of mass (molten alloy) can also become the heat center of the ring. As a result, the selection of a casting ring of sufficient length and diameter to accommodate the patterns to be invested is extremely critical. The casting ring should permit the patterns to be 7-mm apart and 7-mm from the top of the investment, with a minimum 19-mm of investment between them and the ring liner. Unless the basic laws are observed, mold fracture, casting fins, and shrinkage porosity is likely.

Previously, other means and methods for preparing castings and molds have been proposed using what is called a "lost wax" method. This method is well known in the dental field. Dental professionals are aware that casting must be undertaken with care and accuracy to produce a useful product with a precise fit.

The purpose of the crucible former is to allow for a uniform entry point to the sprue former and seal the casting ring at its base. Casting crucible formers are usually made of rubber, plastic, or silicone, which may or may not have a metal insert inside. To form a seal at the base of the casting ring, the crucible former must conform to the shape of the casting ring.

The purpose of the cradle is to hold and support the casting ring on the cradle carriage bars on the Centrifugal Casting Machine during rotation.

The purpose of the tong is for placement, retrieval, and transporting the heated casting ring to and from the worktable, oven, and the cradle on the centrifugal casting machine. The tong must be specifically designed to safely and effectively handle and transport the heated casting ring.

Another problem faced by dental laboratory technicians is the loss of valuable time related to the multiple casting procedures presently needed to fabricate multiple unit fixed partial dentures.

To our knowledge, no one has ever invented or produced anywhere in the world a Horseshoe Shaped Casting Ring, a Horseshoe Shaped Crucible Former, Cradle and Tong as depicted in our invention.

It is toward the resolution of those casting problems that have not been solved by prior art that our present invention is directed.

BRIEF SUMMARY OF THE INVENTION

The purpose of the present invention is to:

1. Address common problems associated with casting arid fabricating multiple unit fixed partial dentures, and the like, by stabilizing the dimensional changes related to heat distortion of the mold. (Items: Horseshoe Shaped Casting Ring and Horseshoe Shaped Crucible Former, hereinafter referred to as "New Casting Ring" and "New Crucible Former").
2. Make available associated equipment needed to maximize the functional operation of the Horseshoe Shaped Casting Ring and Horseshoe Shaped Crucible Former. (Items: Cradle and Tong, hereinafter referred to as "New Cradle" and "New Tong").
3. Provide a new method for securing a more precise fit to the master model when fabricating multiple unit fixed partial dentures, and the like, which can now be achieved in a one step process, thereby making soldering unnecessary. (Items: New Casting Ring and New Crucible Former, New Cradle, and New Tong).
4. Make available newly invented and designed devices whereby dental laboratory technicians can work more efficiently, effectively, and lose less valuable time due to the multiple casting procedures now required when fabricating multiple units fixed partial dentures. (Items: New Casting Ring and New Crucible Former, New Cradle, and New Tong).

The New Casting Ring and New Crucible Former address the common heat distortion problems associated with casting and fabricating multiple unit fixed partial dentures. The New Casting Ring and New Crucible former are contoured in a unique shape that corresponds to the curvature of the natural arch of the mouth which can be compared to a "horseshoe shape". This design provides a more equal amount of investment around the total casting equalizing and stabilizing the amount of heat and expansion, which results from the process. This is important because it results in a more precise fit to the master model.

Equally, if not more importantly, is the fact that the New Casting Ring and New Crucible Former now make it possible to fabricate a multiple unit fixed partial denture in a one step process. Currently, casting and fabricating multiple units fixed partial dentures involves multiple steps, include soldering. Current procedures are not only more time consuming and labor intensive, but also less precise than fabrication using the single step process with the New Casting Ring and New Crucible Former.

The New Casting Ring and New Crucible Former are designed for castings requiring precise and close dimensional tolerances, specifically, those with patterns 7-mm apart and 7-mm from the top of the investment with a minimum 19-mm of investment between the pattern and the ring liner.

The New Cradle is the device that, by virtue of its uniquely designed conforming shape, holds and secures the New Casting Ring in place on the cradle carriage bars on the Centrifugal Casting Machine during rotation.

The specially and uniquely designed New Tong is used for placement, retrieval, and transporting the New Casting Ring to/from the worktable, oven, and cradle in the centrifugal casting machine.

BRIEF DESCRIPTION OF SEVERAL VIEWS OF THE DRAWING

Preferred embodiments of the present invention will now be described in greater detail and will be better understood when read in conjunction with the following drawings in which "like parts" bear "like numerals" throughout the several views:

FIG. 2A is a detailed view depicting how the New Tong's specially designed holes fit over the casting ring's metal handling posts;

DETAILED DESCRIPTON OF THE INVENTION

Figure 8:
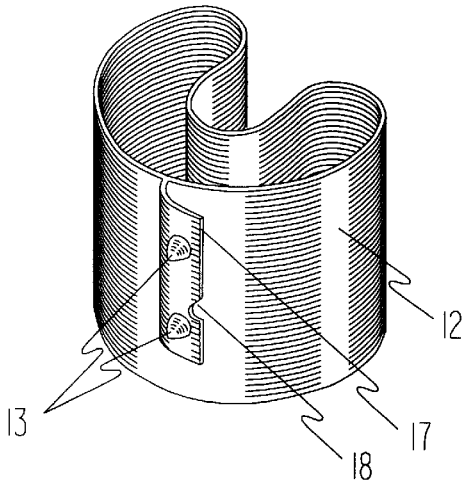
FIG. 8 is a perspective view of the front side and top of our newly invented Horseshoe Shaped Casting Ring which shows two (2) uniquely designed metal handling posts that are mounted onto a raised metal ledge onto which a specially designed New Tong is placed, said metal ledge containing a notched out area which serves as a stabilizing port designed to secure the casting ring onto certain models of centrifugal casting machines.

Our new Horseshoe Shaped Casting Ring of the present invention illustrated in the perspective view FIG. 8 (12) was invented to address common heat distortion problems associated with casting and fabricating multiple unit fixed partial dentures, and the like, by insuring the accuracy and hence the dimensional integrity of the mold. Our New Casting Ring provides a unique method whereby a more precise fit to the master model can be achieved in a one step process when fabricating multiple unit fixed partial dentures, and the like, thereby making soldering unnecessary.

Our New Casting Ring 12 being made from stainless steel or other metal that can withstand extremely high temperatures without losing its shape. This New Casting Ring is made in a variety of sizes including, but not limited to small, medium and large.

Figure 7:
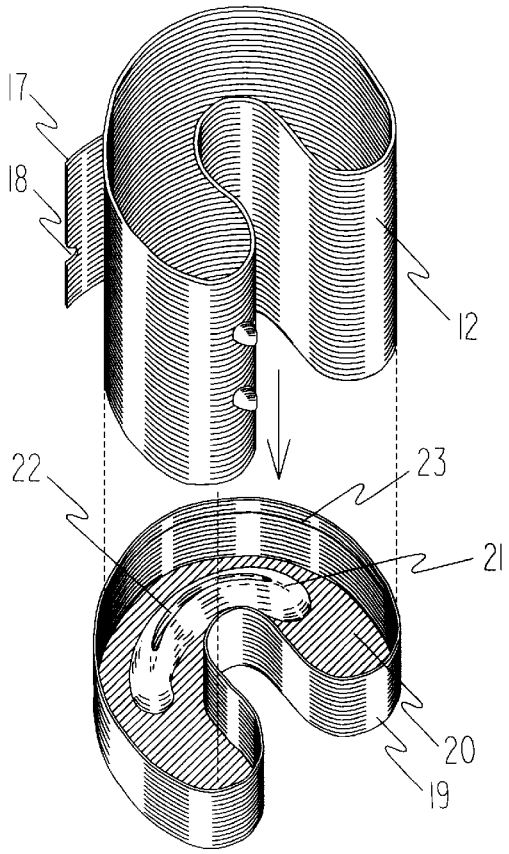
FIG. 7 is a perspective side view of the back side and top of our newly designed Horseshoe Casting Ring showing two (2) metal core shaped mounting posts over which the New Tong is placed for transporting same including a back view of the metal ledge upon which two (2) other metal cone shaped mounting posts are fitted to its opposite side; and, a perspective view of the Horseshoe Shaped Crucible Former illustrating how the two fit together.

Our New Casting Ring 12 being approximately 1 mm thick by approximately 6.5-cm high and approximately 6-cm wide (varying with small, medium and large), said casting ring having a larger radius of approximately 4-cm and a smaller radius of approximately 1.5-cm giving a constant Casting Ring's orifice radius of approximately 2.5-cm. Said Casting Ring's arc being approximately 1-cm past vertical centerline with an ending arc of approximately 1-cm. Said Casting Ring's front side's upper ending arc being the supporting end for the mounting posts 13 located approximately 1.2-cm and 4-cm from top FIG. 7 (13), said Casting Ring's back side being mounted with a raised metal ledge 17 approximately 1.5-cm from horizontal centerline approximately 4.5-cm long and approximately 1.5-cm wide that extends outward approximately 1.5-cm at an angle of approximately 37 degrees continuing away from the front side of the new casting ring. The raised metal ledge has two (2) metal cone shaped handling posts mounted on top 26 measuring from the upper edge 1.25-cm and 2.5-cm. Metal Cone Shaped Mounting Posts 26 measuring approximately 1-cm at their base extending and tapering upward approximately 6-mm to a point. These two metal cone shaped handling posts 26 and the two (2) other metal cone shaped handling posts 13 that are mounted directly to the surface of the back side of the casting ring 12 fit into the handling post receptacle holes 10 on the side of the New Tong 11 for transporting the New Casting Ring, all metal cone shaped handling posts being of equal dimensions. Our New Casting Ring's four (4) metal cone shaped handling posts 13, 26 fit snugly FIG. 2 (10, 13) into the specifically designed handling post receptacle holes 10 in the New Tong 11.

An inverted "notched out" area is cut into the outer edge of the raised metal ledge 17 serves as a receptacle or port 18 on the New Casting Ring 12. The raised metal ledge 17 and "notched out" receptacle or port 18 becomes a stabilizer for securing the New Casting Ring when placed on the cradle carriage bars on certain models of centrifugal casting machines.

Figure 5:
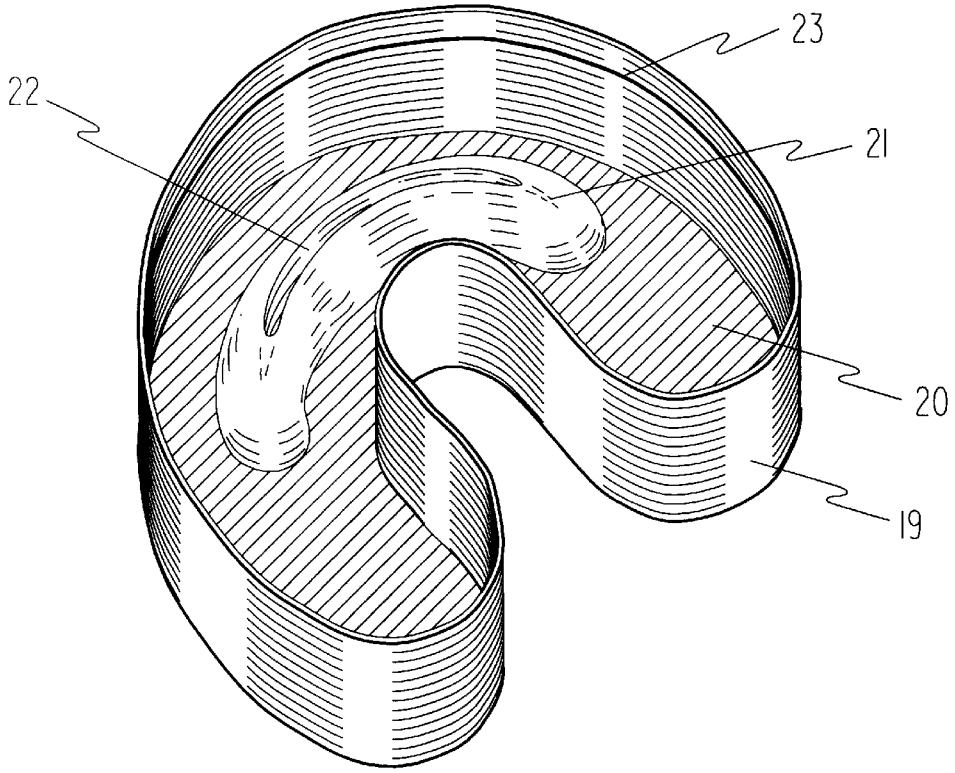
FIG. 5 is a perspective view of our newly designed Horseshoe Shaped Crucible Former which corresponds to the shape of our newly invented Horseshoe Shaped Casting Ring.

The purpose of our New Crucible Former FIG. 5 (19–23) is to form an entry point to the sprue former and liquid tight seal for the New Casting Ring at its base. Our New Horseshoe Shaped Crucible Former of the present invention illustrated in the perspective view FIG. 5 (19–23), FIG. 7 (19–23) is designed to correspond to the shape of the newly invented Horseshoe Shaped Casting Ring 12 so as to facilitate the New Casting Ring's use. Said New Crucible Former FIG. 5 (19–23) being approximately 2-mm thick by approximately 1.5-cm high and approximately 6-cm wide (varying with small, medium and large), said Crucible Former having a larger radius of approximately 4.1-cm and a smaller radius of approximately 1.6-cm giving expansion capability to said Crucible Former, Said Crucible Former being approximately 1-cm past vertical centerline with an ending arc of approximately 1-cm.

Figure 6:
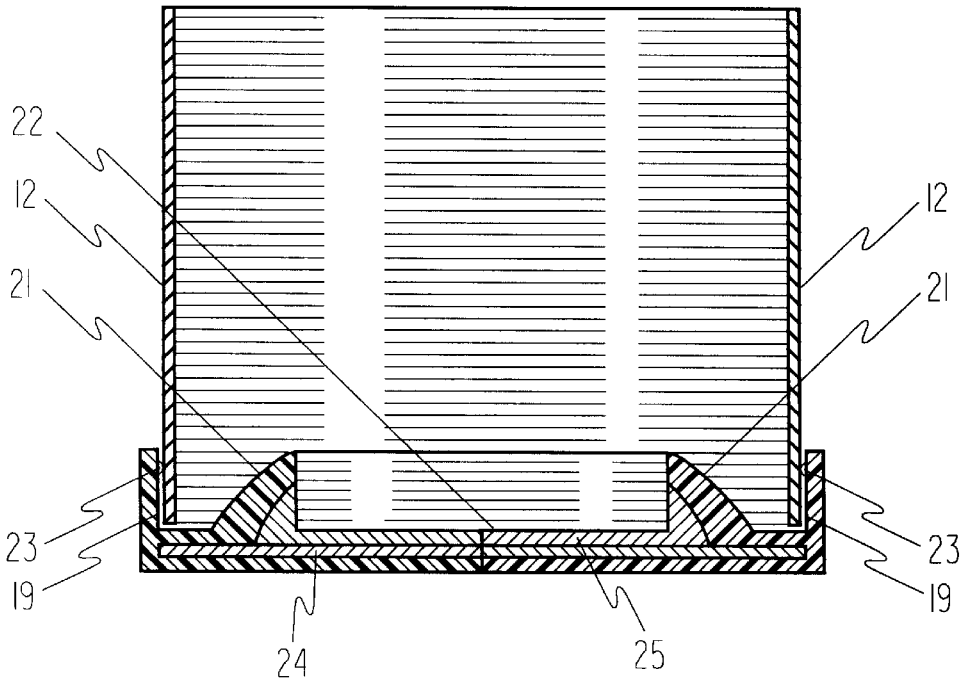
FIG. 6 cross sectional view of our newly designed Horseshoe Shaped Casting Ring and Horseshoe Shaped Crucible Former fitted together showing the construction components and internal design features.
Figure 9:
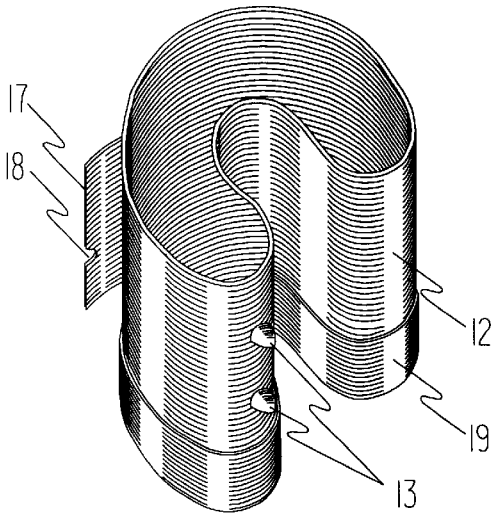
FIG. 9 is a perspective view of the backside and top of our newly designed Horseshoe Shaped Casting Ring showing the Horseshoe Shaped Crucible Former attached to its base.

A cross sectional view of our newly designed Horseshoe Shaped Casting Ring and Horseshoe Shaped Crucible Former FIG. 6 depicts the construction materials and internal design features, the New Casting Ring FIG. 6 (12), the New Crucible Former's component parts FIG. 6 (19–23)

comprising a flat Horseshoe shaped metal, 24 approximately 1-mm thick upon which another semicircular shaped metal reservoir 25 being affixed by glue or other adhesive material, said semicircular shaped metal reservoir 25 extending and tapering upward at an angle of approximately 60-degrees on each side 25A, said semicircular shaped metal reservoir forming a semicircular shaped trough or cavity FIG. 5 (22), FIG. 6 (22) extending downwardly approximately 11-mm deep being approximately 2-mm wide from top to bottom with all walls at 90-degree angles 22, said flat Horseshoe shaped metal 24 and semicircular shaped metal reservoir 25, 25A each having its outer surface being uniformly covered with approximately 2-mm of plastic or rubber 19, 20, except said plastic or rubber covering 21 becoming thicker as the angle of 21 is approximately 47-degrees, said plastic or rubber containing a small retaining annular flange 23 approximately 1-mm wide, protruding approximately 0.5-mm at a 90-degree angle from the interior wall extending completely around the interior wall, said retaining annular flange 23 being situated approximately 8-mm above the New Crucible Former's floor 20, said retaining annular flange 23 being designed to secure in place the New Crucible Former FIG. 5 once mounted onto the New Casting Ring as illustrated in FIG. 6, FIG. 9 (19). The inner dimension of the New Crucible Former 19 being approximately 1-mm larger than the outer dimension of the New Casting Ring 12 thereby allowing the New Crucible Former to overlap telescopically the New Casting Ring.

Figure 3:
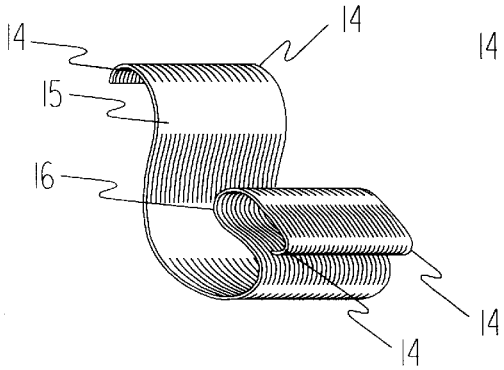
FIG. 3 is a perspective view of our New Cradle which, shows the uniquely designed shape which conforms to one side of our New Horseshoe Shaped Casting Ring, and semi-circular curved ends that enable it to be mounted onto the cradle carriage bars on the Centrifugal Casting Machine to secure it during rotation.
Figure 4:
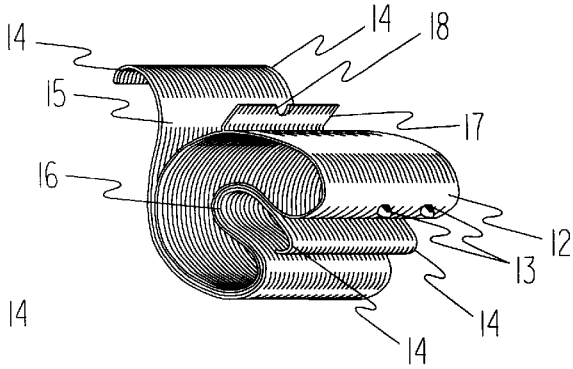
FIG. 4 is a perspective view of our New Horseshoe Shaped Casting Ring positioned upon our New Cradle which mounts onto the cradle carriage bars on the Centrifugal Casting Machine.

A cradle FIG. 3 (14–16) is a holding device that supports a casting ring while it is positioned on the cradle carriage bars on the Centrifugal Casting Machine. The horseshoe shape of the casting ring 12 allows the casting ring to saddle over and conform to the "U" shaped inside curve of the cradle FIGS. 3, 4 (16). The front side of the horseshoe shaped casting ring 12 rests against cradle which corresponds to the shape of the casting ring until it bends outward toward FIGS. 3, 4 (15) the cradle carriage bars on the centrifugal casting machine. Our New Casting Ring FIG. 4 (12) requires a newly designed Cradle because there are no other Cradles that conform to the unique shape of the New Casting Ring to hold it securely in place on the cradle carriage bars on Centrifugal Casting Machines currently available. The New Cradle FIG. 4 is supported on the metal bars of the centrifugal machine by the contoured semicircular shaped ends of the New Cradle 14 so that they clutch and rest securely upon the two cradle carriage bars of the centrifugal casting machine. The New Cradle 14–16 is made from 1-mm stainless steel or other metal that can withstand extremely high temperatures without loosing its shape. The distance between the carriage bars on the currently available centrifugal casting machines is constant; the distance between the flanges on our new cradle is constant being approximately 9.5-cm. The medium sized cradle, being 5.5-cm wide by 6.5-cm deep, conforming to the general contour of our New Casting Ring's outer surface on the opposite side from the metal mounting posts thereby creating an interlocking fit that secures the New Casting Ring during the rapid spin cycle. FIG. 4 depicts our New Cradle with our New Casting Ring positioned and resting upon it. The New Cradle, with the heated New Casting Ring in this position FIG. 4, is spun around in the centrifugal casting machine at high speeds.

The purpose of the Tong 12 is to safely and effectively handle and transport the heated casting ring. The New Tong of the present invention FIG. 1, further illustrated in the perspective view FIG. 2, is required for placement, retrieval, and transporting the heated New Casting Ring to/from the worktable, oven, and the cradle on the centrifugal casting machine, said New Tong being made from stainless steel or other metal that can withstand extremely high temperatures without loosing its shape and recoil characteristics being approximately 1 mm thick by approximately 2.7-cm wide and approximately 35-cm providing a sufficient length to provide a desirable margin of safety when transporting the New Casting Ring 12, said tong having a radius of approximately 1.5-cm at the closed end, the open or gripper end of said tong being approximately 5.5-cm wide tapering a distance of approximately 3-cm toward closed end or handle. The New Tong 11 being designed with two (2) holes in each side 10 the same diameter of the mounting posts 13 on the casting ring 12 that serve as receptacles for the four (4) metal handling posts 13, 26 to insure a firm and secure grip for safe handling and quick release of the New Casting Ring 12 that becomes extremely hot during use. No other Tong is available that meets the requirements for safe and effective handling of our New Casting Ring.

By utilizing our New Casting Ring FIG. 8 and New Crucible Former FIG. 5, dental laboratory technicians can overcome common problems associated with casting and fabricating multiple unit fixed partial dentures, and the like, by stabilizing the dimensional changes related to heat distortion of the mold. They can work more efficiently, effectively, and lose less valuable time due to the multiple casting procedures now required when fabricating multiple unit fixed partial dentures, and the like. Likewise, our New Casting Ring and New Crucible Former provides a new method for securing a more precise fit to the master model when fabricating multiple unit fixed partial dentures, and the like, which can now be achieved in a one step process, thereby making soldering unnecessary.

Figure 1:
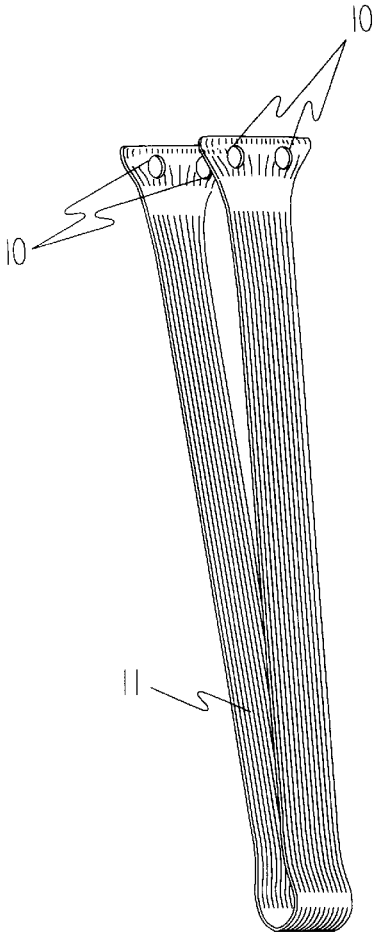
FIG. 1 is a prospective view of our New Tong used exclusively for this invention for placement, retrieval and transporting the casting ring to/from the worktable, oven, and cradle in the centrifugal casting machine.
Figure 2:
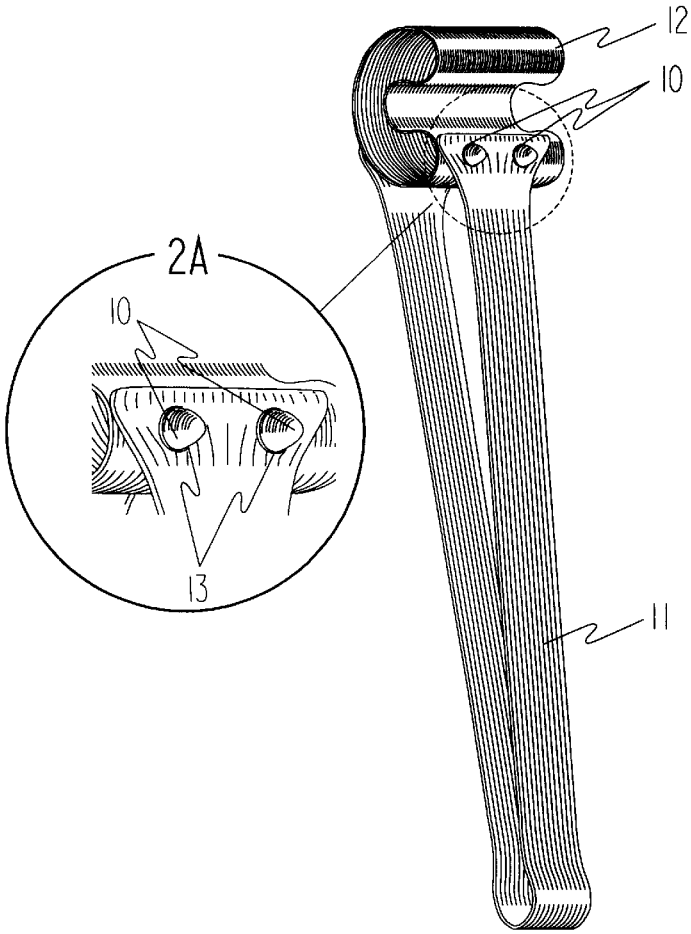
FIG. 2 is a perspective view of our newly invented Horseshoe Shaped Casting Ring being transported by our New Tong.

By utilizing our New Cradle FIG. 3 and New Tong FIG. 1, dental laboratory technicians will have the necessary associated equipment needed to maximize the functional operation of our New Casting Ring and New Crucible Former.

What is claimed is:

1. An assembly for casting comprising:

a horseshoe shaped casting ring having a plurality of handling posts;

a horseshoe shaped crucible former having a flange for retaining the casting ring and a top surface for supporting the casting ring; and a pair of tongs having a plurality of openings, each of the openings adapted to receive one of the plurality of handling posts.

2. The assembly of claim 1 wherein the casting ring is made of a metal.

3. The assembly of claim 2 wherein the metal is stainless steel.

4. The assembly of claim 1 wherein the crucible former is made of a metal covered with plastic or rubber.

5. The assembly of claim 1 wherein the pair of tongs is made of a metal.

6. The assembly of claim 5 wherein the metal is stainless steel.

7. The assembly of claim 1, further comprising a cradle having a curvature corresponding to one side of the horseshoe shaped casting ring for holding the casting ring on a centrifugal casting machine.

8. The assembly of claim 7 wherein the cradle is made of a metal.

9. The assembly of claim 8 wherein the metal is stainless steel.

* * * * *